US012049737B2

(12) United States Patent
Sun et al.

(10) Patent No.: US 12,049,737 B2
(45) Date of Patent: Jul. 30, 2024

(54) MOORING DEVICE CAPABLE OF PROVIDING OMNIDIRECTIONAL RESTORING FORCE

(71) Applicant: DALIAN UNIVERSITY OF TECHNOLOGY, Liaoning (CN)

(72) Inventors: Lei Sun, Dalian (CN); Chong Fu, Dalian (CN); Zhe Lin, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 974 days.

(21) Appl. No.: 17/043,792

(22) PCT Filed: Mar. 17, 2020

(86) PCT No.: PCT/CN2020/079599

§ 371 (c)(1),
(2) Date: Sep. 30, 2020

(87) PCT Pub. No.: WO2021/017482

PCT Pub. Date: Feb. 4, 2021

(65) Prior Publication Data

US 2022/0025598 A1 Jan. 27, 2022

(30) Foreign Application Priority Data

Jul. 29, 2019 (CN) ..... 201910687078.8
Jul. 29, 2019 (CN) ..... 201921199339.3

(51) Int. Cl.
*B63B 21/20* (2006.01)
*B63B 21/04* (2006.01)
(Continued)

(52) U.S. Cl.
CPC ..... *E02B 3/064* (2013.01); *B63B 21/04* (2013.01); *B63B 21/20* (2013.01); *B63B 2021/203* (2013.01); *E02B 3/26* (2013.01)

(58) Field of Classification Search
CPC . E02B 3/064; E02B 3/26; B63B 21/04; B63B 21/20; B63B 2021/203
See application file for complete search history.

(56) References Cited

U.S. PATENT DOCUMENTS 4,998,497 A * 3/1991 Nelson ..... B63B 21/00 114/230.19
5,524,566 A * 6/1996 Rapa ..... B63B 21/00 114/230.22
5,749,535 A * 5/1998 Kahn, III ..... B63B 21/04 114/230.22

FOREIGN PATENT DOCUMENTS

CN 109878635 A * 6/2019
EP 2071083 B1 * 2/2012 ..... E02B 3/26
KR 20140014727 A * 2/2014

* cited by examiner

*Primary Examiner* — Kyle Armstrong
(74) *Attorney, Agent, or Firm* — McCarter & English, LLP; Yu Lu

(57) ABSTRACT

The present invention provides a mooring device capable of providing an omnidirectional restoring force. A support frame is provided on a dock. Two free guide rollers are provided at vertical corresponding positions that are respectively below a cross arm of the support frame and above the dock. A rotary damper is provided in the middle of a longitudinal portion of the support frame that is perpendicular to the dock. The two free guide rollers are respectively wound with a cable. The cable is fixed to a platform arm, and the platform arm is connected to a platform. An end of each cable is connected to a spring, and the other end of the spring is connected to a chain wound on a sprocket of the rotary damper.

19 Claims, 4 Drawing Sheets

(51) Int. Cl.
*E02B 3/06* (2006.01)
*E02B 3/26* (2006.01)

MOORING DEVICE CAPABLE OF PROVIDING OMNIDIRECTIONAL RESTORING FORCE

CROSS-REFERENCE TO RELATED APPLICATIONS

This application is a U.S. national stage filing, under 35 U.S.C. § 371(c), of International Application No. PCT/CN2020/079599, filed on Mar. 17, 2020, which claims priority to Chinese Patent Application No. 201910687078.8, filed on Jul. 29, 2019, and Chinese Patent Application No. 201921199339.3, filed on Jul. 29, 2019. The entire contents of each of the aforementioned applications are incorporated herein by reference.

TECHNICAL FIELD

The present invention relates to the technical field of mooring.

BACKGROUND

Mooring refers to the process of using mooring equipment to make a vessel, buoy, platform, etc. safely stay on an anchor, shore or mooring pontoon. The mooring system includes a dock, trestle berth, dolphin, mooring pontoon and another vessel to moor to. The bow is generally moored against the tide in ports with dominant tides and against the wind in ports where the wind scale goes to a force of over 4.

The traditional mooring device directly ties the vessel and platform, etc. to the dock or other equipment through cables. In case of tidal fluctuation or severe conditions like strong winds and waves, it is difficult to maintain the stability of the vessel or platform, especially a platform requiring high stability, for example, a nuclear reactor platform.

SUMMARY

In order to ensure the stability of the mooring of vessels, platforms and other equipment, the present invention provides a mooring device capable of providing an omnidirectional restoring force.

In order to achieve the above objective, the present invention adopts the following technical solution:

A mooring device capable of providing an omnidirectional restoring force, where a support frame is provided on a dock; two free guide rollers are provided at vertical corresponding positions that are respectively below a cross arm of the support frame and above the dock; the two free guide rollers are respectively wound with a cable; one end of each cable is connected to a platform arm fixed on a platform, and the other end thereof is connected with one end of a spring; the other end (tail end) of the spring is connected with a damper.

Further, when the damper is a rotary damper, the tail ends of the springs transmit power through cooperation of a chain and a sprocket on a damping shaft of the rotary damper; that is, the springs pull the chain, and the chain drives the damping shaft of the rotary damper to rotate to finally realize damping by dissipation of energy.

Further, there is one damper (rotary damper), and the damper is fixed to the middle of a longitudinal portion of the support frame that is perpendicular to an upper surface of the dock;

the tail ends of the two springs are connected by one chain, so as to realize the symmetrical arrangement of the springs or adjust an inclination of a single spring (an angle between a central axis of the spring and a horizontal plane).

Further, the two springs are respectively provided in a spring sleeve, and the chain is provided thereon with a chain stopper at an end of the two spring sleeves, respectively.

Further, two anti-collision fairlead bases are provided in correspondence in a vertical direction of the cables below the cross arm of the support arm and above the dock; the anti-collision fairlead bases are respectively composed of legs and a base surface; lower ends of the legs are fixed on the cross arm of the support frame or the dock; the base surface is provided on the top of the legs; a center of the base surface is provided with a limiting hole for the cable to penetrate through; an upper surface of the base surface is made of an elastic material.

Further, roller supports of the free guide rollers are respectively provided on a lower side of the cross arm of the support frame and on the dock; a roller is provided on an upper part of the roller support; a roller groove is provided on a central circumference of the roller, and an anti jumping baffle is provided on the upper part of the roller support on an outer side of the roller; a groove corresponding to the roller groove is provided on an inner side of the anti jumping baffle.

Further, the rotary damper includes a sprocket support fixed on the longitudinal portion of the support frame; the sprocket support is provided thereon with a sprocket; a transmission shaft passes through the sprocket support; the transmission shaft on one side of the sprocket support is provided thereon with a clutch, a reduction gear box and an electronic inertial sensor in sequence from inside to outside; the transmission shaft on the other side of the sprocket support is provided thereon with a clutch, a reduction gear box and a drive motor in sequence from inside to outside.

Further, the two cables located on upper and lower sides of the platform arm are connected to the platform arm through a connection joint; the connection joint is provided with a U-shaped groove; connecting holes are provided on both sides of the U-shaped groove, and holes corresponding to the connecting holes are provided on the platform arm; the connection joint is fixedly provided by penetrating a connecting rod through the platform arm holes and the connecting holes.

Further, a side of the dock is provided with fenders between the platform and the dock.

The mooring device of the present invention provides an omnidirectional restoring force for the moored platform through the elastic deformation of the springs to control the movement response of the platform within a certain range. The mooring system can adjust its vertical equilibrium position accordingly to adapt to the change in the vertical equilibrium position of the platform caused by tidal fluctuation, and untie the moored platform safely and quickly as required in extreme cases.

Figure 1:
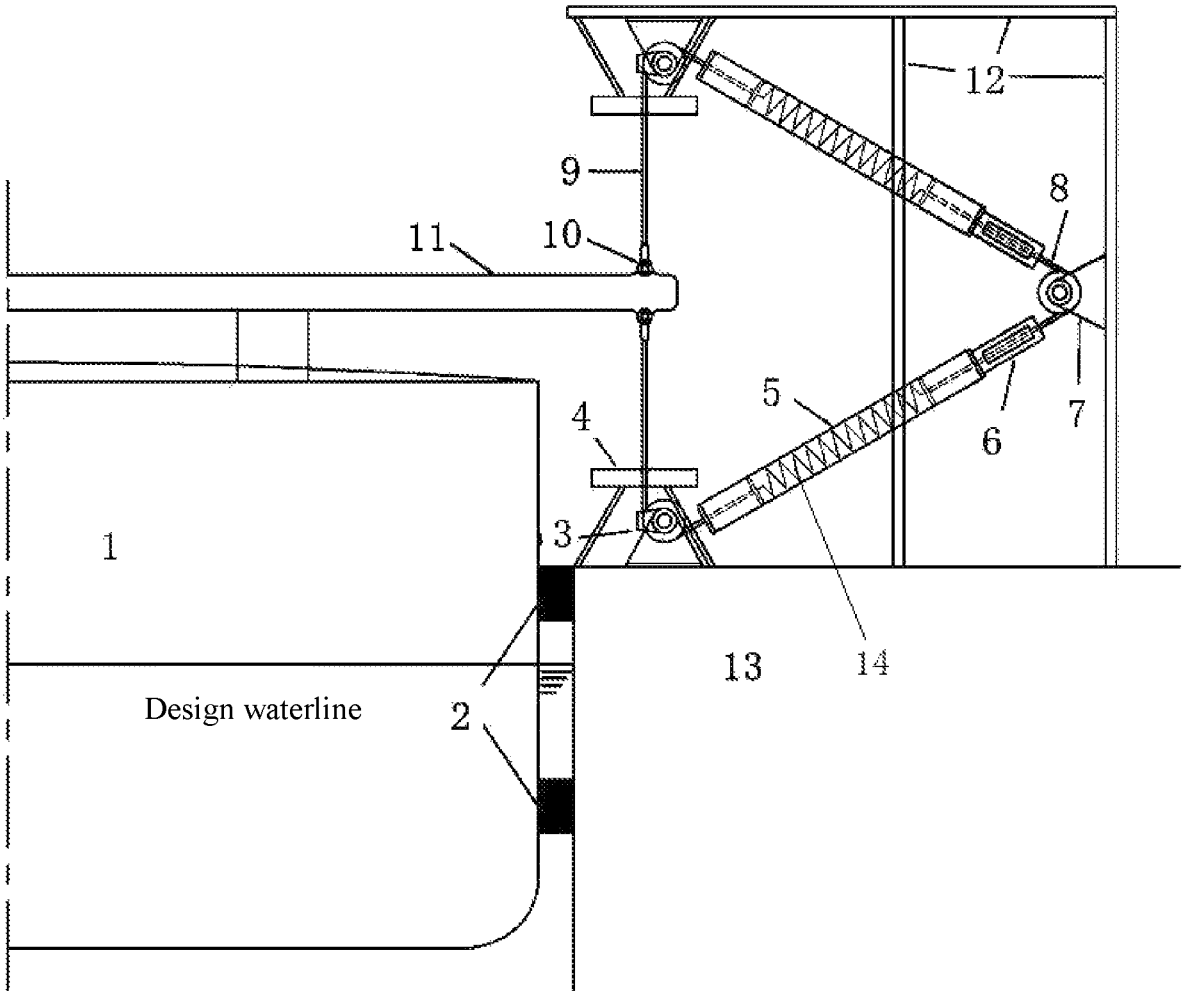
FIG. 1 is a front view of a mooring device capable of providing an omnidirectional restoring force according to the present invention.

Reference Numerals: 1. platform; 2. fender; 3. free guide roller; 3-1. roller groove; 3-2. anti jumping baffle; 3-3. roller support; 4. anti-collision fairlead base; 4-1. limiting hole; 4-2. base surface; 4-3. leg; 5. spring sleeve; 6. chain stopper; 7. rotary damper; 7-1. drive motor; 7-2. reduction gear box; 7-3. clutch; 7-4. transmission shaft; 7-5. sprocket support; 7-6. sprocket; 7-7. electronic inertial sensor; 8. chain; 9. cable; 10. connection joint; 10-1. connecting hole; 10-2. groove; 11. platform arm; 12. support frame; 13. dock; and 14. spring.

DETAILED DESCRIPTION

It should be noted that the examples in the present invention or features in the examples may be combined in a non-conflicting manner. The present invention is described in detail below with reference to the accompanying drawings and examples.

It should be understood that, in the description of the present invention, terms such as "front", "rear", "upper", "lower", "left", "right", "transverse", "longitudinal", "vertical", "horizontal", "top" and "bottom" indicate orientation or position relationships based on the accompanying drawings. Unless otherwise specified, these terms are merely intended to facilitate or simplify the description of the present invention, rather than to indicate or imply that the mentioned device or components must have a specific orientation and must be constructed and operated in a specific orientation. Therefore, they should not be construed as a limitation to the protection scope of the present invention. The orientation terms "inner" and "outer" refer to the inner and outer parts relative to the contour of the mentioned component.

For ease of description, spatially relative terms, such as "above", "on the upper side of", "on the upper surface of" and "on", can be used to describe the spatial position relationship between components or features shown in the figure. It should be understood that the spatially relative terms are intended to encompass different orientations of the components in use or operation in addition to those shown in the figure. For example, if a component in the figure is inverted, it is described as a component "above other component or structure" or "on other component or structure", and it will be positioned as "below other component or structure" or "under other component or structure". Therefore, the exemplary term "above" may include both orientations "above" and "below". The component may also be positioned in other different ways (rotated by 90 degrees or in other orientations), but the relative description of the space should be explained accordingly.

The present invention provides a mooring device capable of providing an omnidirectional restoring force. As shown in FIG. 1, an overall structural view of the mooring device, a support frame 12 is provided on a dock 13; two free guide rollers 3 are provided at vertical corresponding positions that are respectively below a cross arm of the support frame 12 and above the dock 13; the two free guide rollers 3 are respectively wound with a cable 9; one end of each cable 9 is connected to a platform arm 11 fixed on a platform 1, and the other end thereof is connected with one end of a spring 14; the other end (tail end) of the spring 14 is connected with a damper.

When the damper is a rotary damper 7, the tail ends of the springs 14 transmit power through cooperation of a chain 8 and a sprocket on a damping shaft of the rotary damper 7. That is, the springs 14 pull the chain 8, and the chain 8 drives the damping shaft of the rotary damper 7 to rotate to finally realize damping by dissipation of energy.

There is one damper (rotary damper 7), and the damper is fixed to the middle of a longitudinal portion of the support frame 12 that is perpendicular to an upper surface of the dock 13.

The tail ends of the two springs 14 are connected by one chain 8, so as to realize the symmetrical arrangement of the springs 14 or adjust an inclination of a single spring 14 (an angle between a central axis of the spring and a horizontal plane).

The two springs 14 are respectively provided in a spring sleeve 5, and the chain 8 is provided thereon with a chain stopper 6 at an end of the two spring sleeves 5, respectively. A side of the dock 13 is provided with fenders 2 between the platform 1 and the dock 13.

Figure 2:
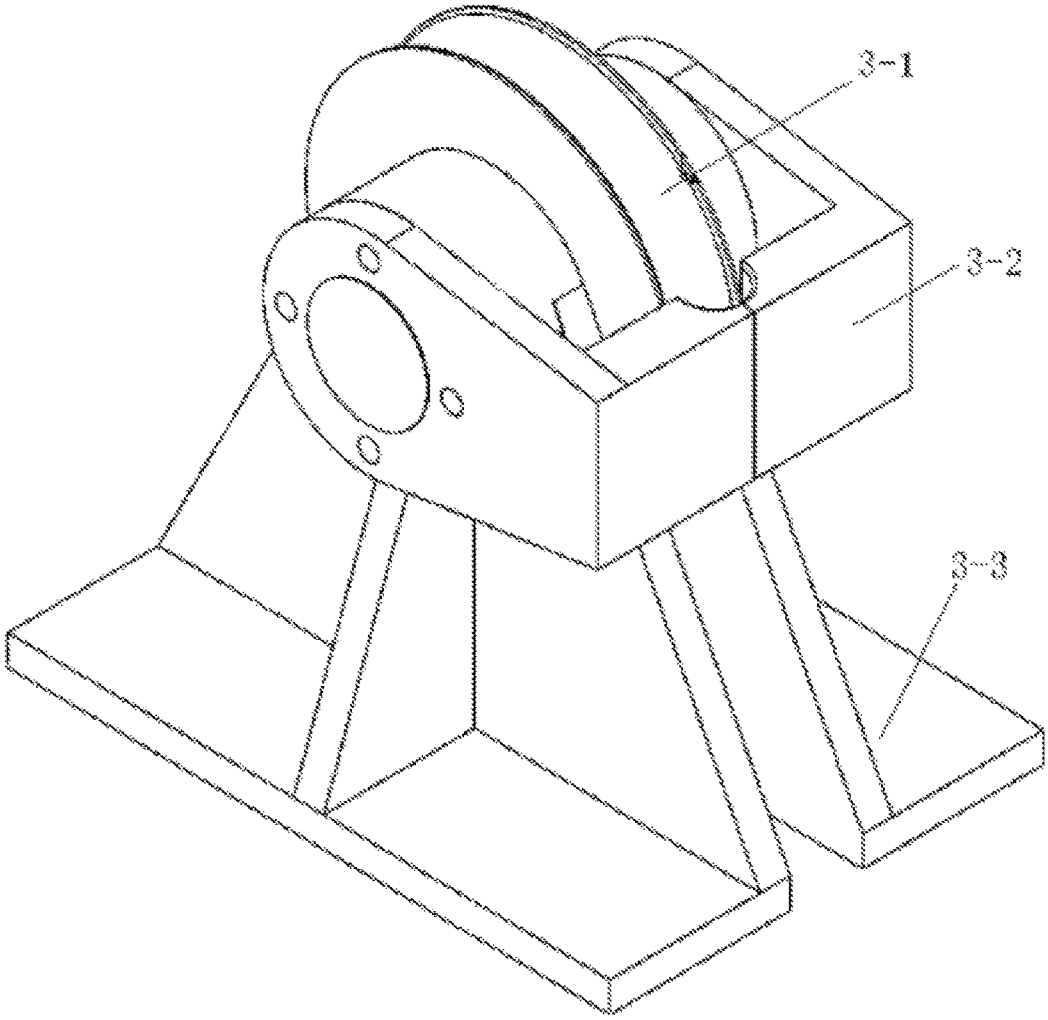
FIG. 2 is a structural view of a free guide roller of the mooring device capable of providing an omnidirectional restoring force according to the present invention.

As shown in FIG. 2, roller supports 3-3 of the free guide rollers 3 are respectively provided on a lower side of the cross arm of the support frame 12 and on the dock 13. A roller is provided on an upper part of the roller support 3-3. A roller groove 3-1 is provided on a central circumference of the roller, and an anti jumping baffle 3-2 is provided on the upper part of the roller support 3-3 on an outer side of the roller. A groove corresponding to the roller groove 3-1 is provided on an inner side of the anti jumping baffle 3-2 to prevent the cable 9 from leaving the roller groove 3-1.

Figure 3:
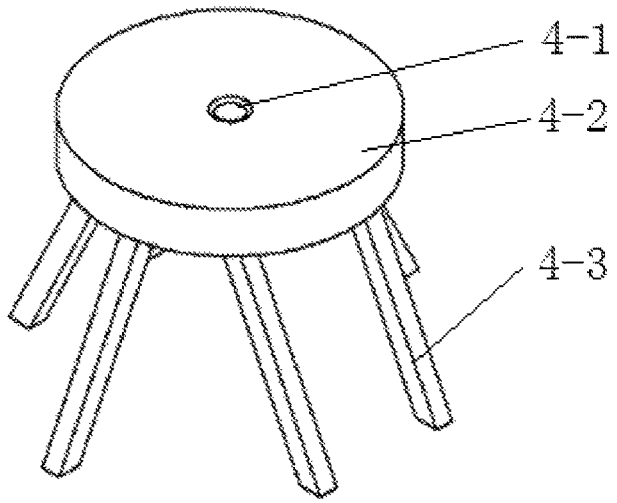
FIG. 3 is a structural view of an anti-collision fairlead base of the mooring device capable of providing an omnidirectional restoring force according to the present invention.

Two anti-collision fairlead bases 4 are provided in correspondence in a vertical direction of the cables 9 below the cross arm of the support arm 12 and above the dock 13. The anti-collision fairlead bases 4 are respectively composed of legs 4-3 and a base surface 4-2. Lower ends of the legs 4-3 are fixed on the cross arm of the support frame 12 or the dock 13. The base surface 4-2 is provided on the top of the legs 4-3. A center of the base surface 4-2 is provided with a limiting hole 4-1 for the cable 9 to penetrate through. An upper surface of the base surface 4-2 of each anti-collision fairlead base 4 is made of an elastic material to buffer an impact of the platform arm 11 during movement. The limiting hole 4-1 in the center can control the horizontal movement of the cable 9. The structure of the anti-collision fairlead base 4 is shown in FIG. 3.

Figure 4:
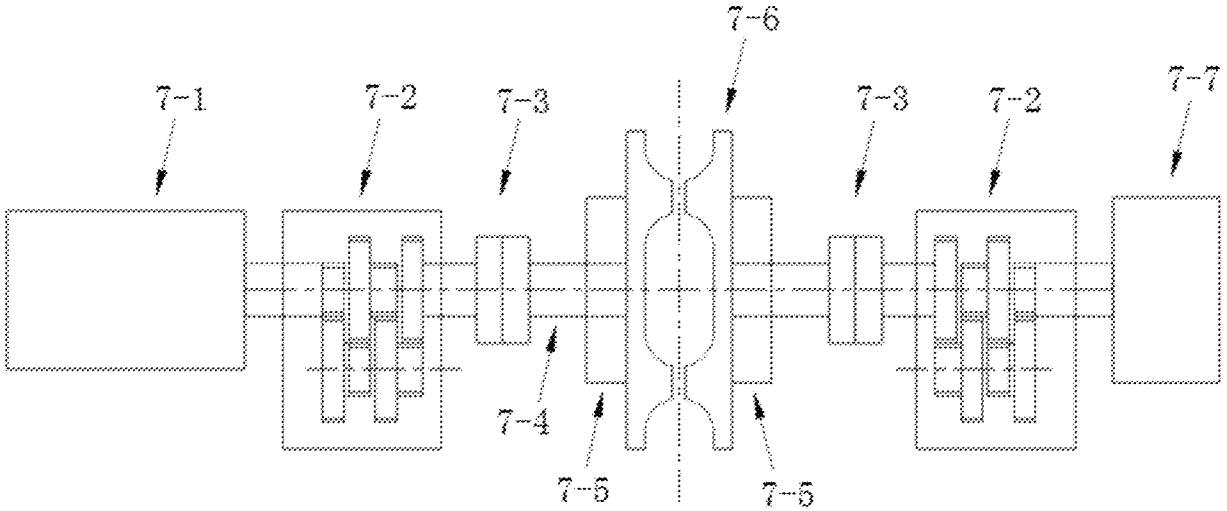
FIG. 4 is a structural view of a rotary damper of the mooring device capable of providing an omnidirectional restoring force according to the present invention.

As shown in FIG. 4, the rotary damper 7 includes a sprocket support 7-5 fixed on the longitudinal portion of the support frame 12. The sprocket support 7-5 is provided thereon with a sprocket 7-6. A transmission shaft 7-4 passes through the sprocket support 7-5. The transmission shaft 7-4 on one side of the sprocket support 7-5 is provided thereon with a clutch 7-3, a reduction gear box 7-2 and an electronic inertial sensor 7-7 in sequence from inside to outside. The transmission shaft 7-4 on the other side of the sprocket support 7-5 is provided thereon with a clutch 7-3, a reduction gear box 7-2 and a drive motor 7-1 in sequence from inside to outside. The electronic inertial sensor 7-7, the reduction gear box 7-2 and the clutch 7-3 (the latter two are on the same side as the electronic inertial sensor) compose an inertial control mechanism, where the transmission shaft 7-4 is connected with the sprocket 7-6, and can lock the sprocket when the sprocket 7-6 rotates too fast (or with a too large acceleration). The drive motor 7-1, the reduction gear box 7-2 and the clutch 7-3 compose an active driving mechanism, where the rotation of the sprocket is controlled by the transmission shaft 7-4. The two mechanisms operate independently without interfering with each other.

Figure 5:
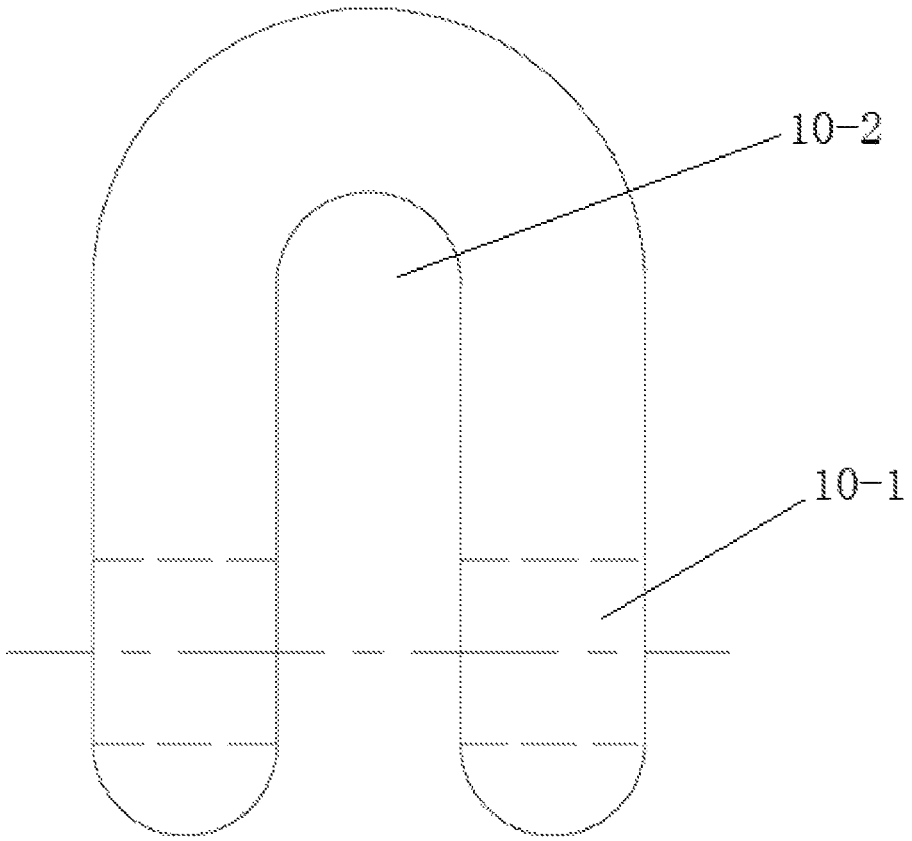
FIG. 5 is a structural view of a connection joint of the mooring device capable of providing an omnidirectional restoring force according to the present invention.

The two cables 9 located on upper and lower sides of the platform arm 11 are connected to the platform arm 11 through a connection joint 10. As shown in FIG. 5, the connection joint 10 is provided with a U-shaped groove. Connecting holes 10-1 are provided on both sides of the U-shaped groove, and holes corresponding to the connecting holes 10-1 are provided on the platform arm 11. The connection joint 10 is fixedly provided by penetrating a connecting rod through the platform arm holes and the connecting holes 10-1. The connection joint 10 is a quick detachable joint, which can quickly disconnect the platform arm 11 from the mooring system.

The mooring device works as follows:

(1) In the absence of strong winds and waves: The clutch 7-3 in the inertial sensing mechanism of the rotary damper 7 is engaged to connect the inertial sensing mechanism with the sprocket 7-6, and the clutch 7-3 in the active driving mechanism is disengaged. The springs in the spring sleeves 5 do not stretch. In the mooring system, the cables 9 and the springs 14 perform linear motion through the rotation of the two free guide rollers 3 and the rotary damper 7, so as to change a vertical position of the connection joint 10 on the platform arm 11. The vertical position of the connection joint serves as an equilibrium position of the mooring system. In this position, the system provides no restoring force. The mooring system has only one equilibrium position in space at various tidal levels. When the tied platform 1 slowly rises and falls as a whole due to tidal fluctuation, the position of the platform 1 is adjusted through the change of the vertical position of the platform arm 11. The mooring device changes the vertical position accordingly without causing additional load to the mooring system, thereby adapting the mooring to tidal fluctuation.

The rise and fall of the platform 1 and the movement of the mooring mechanism (including the rotation of the rotary damper 7 in the mooring system) caused by tidal fluctuation are slow. When an instantaneous external load such as a gust of wind acts on the platform, the platform and the mooring mechanism will produce a movement with large acceleration, and the inertial mechanism of the rotary damper 7 will lock the sprocket 7-6 so that it cannot rotate. Thus, the equilibrium position of the mooring system is fixed, and the movement of the platform will drive the springs 14 in the spring sleeves 5 to expand and contract to provide a restoring force to resist the accidental load.

(2) In the presence of strong winds and waves (storm surges): The clutch 7-3 in the active driving mechanism of the rotary damper 7 is engaged to connect the active driving mechanism with the sprocket 7-6, and the clutch 7-3 in the inertial sensing mechanism is disengaged.

In case of short-term severe conditions, the chain 8 is locked by the chain stopper 6 to fix the equilibrium position of the mooring system, and the springs in the spring sleeves 5 expand and contract to provide the platform with an omnidirectional restoring force.

In case of long-term severe conditions, the tidal level may change significantly due to storm surges, etc. In order to avoid platform tilting and extra load caused by the lock of the equilibrium position of the mooring system, the mooring system is adjusted according to tidal fluctuation. During the adjustment process, the rotary damper 7 is in an active driving mechanism control state. The chain stopper 6 unlocks the chain 8, and the active driving mechanism controls the sprocket 7-6 in the rotary damper 7 to rotate, thereby adjusting the equilibrium position of the mooring system according to a detected average water level. After the mooring system is adjusted in position, the chain stopper 6 locks the chain, and a restoring force is provided in the above manner.

The present invention is described with reference to the examples, and those skilled in the art should know that various changes or equivalent substitutions can be made to the features and examples of the present invention without departing from the spirit and scope of the present invention. In addition, under the concept of the present invention, these features and examples can be modified to adapt to specific conditions and materials without departing from the spirit and scope of the present invention. Therefore, the present invention is not limited by the disclosed specific examples, and all examples falling within the scope of the claims of this application should belong to the protection scope of the present invention.

What is claimed is:

1. A mooring device capable of providing an omnidirectional restoring force, wherein a support frame (12) is provided on a dock (13); two free guide rollers (3) are provided at vertical corresponding positions that are respectively below a cross arm of the support frame (12) and above the dock (13); the two free guide rollers (3) are respectively wound with a cable (9); one end of each cable (9) is connected to a platform arm (11) fixed on a platform (1), and the other end thereof is connected with one end of a spring (14); the other end (tail end) of the spring (14) is connected with a damper.

2. The mooring device capable of providing an omnidirectional restoring force according to claim 1, wherein the damper is a rotary damper (7); the tail ends of the springs (14) transmit power through cooperation of a chain (8) and a sprocket on a damping shaft of the rotary damper (7).

3. The mooring device capable of providing an omnidirectional restoring force according to claim 2, wherein there is one damper, and the damper is fixed to the middle of a longitudinal portion of the support frame (12) that is perpendicular to an upper surface of the dock (13); the tail ends of the two springs (14) are connected by one chain (8).

4. The mooring device capable of providing an omnidirectional restoring force according to claim 3, wherein the two springs (14) are respectively provided in a spring sleeve (5), and the chain (8) is provided thereon with a chain stopper (6) at an end of the two spring sleeves (5), respectively.

5. The mooring device capable of providing an omnidirectional restoring force according to claim 3, wherein two anti-collision fairlead bases (4) are provided in correspondence in a vertical direction of the cables (9) below the cross arm of the support arm (12) and above the dock (13); the anti-collision fairlead bases (4) are respectively composed of legs (4-3) and a base surface (4-2); lower ends of the legs (4-3) are fixed on a lower side of the cross arm of the support frame (12) or on the dock (13); the base surface (4-2) is provided on the top of the legs (4-3); a center of the base surface (4-2) is provided with a limiting hole (4-1) for the cable (9) to penetrate through; an upper surface of the base surface (4-2) is made of an elastic material.

6. The mooring device capable of providing an omnidirectional restoring force according to claim 3, wherein roller supports (3-3) of the free guide rollers (3) are respectively provided on the lower side of the cross arm of the support frame (12) and on the dock (13); a roller is provided on an upper part of the roller support (3-3); the roller is provided with a roller groove (3-1) for winding the cable (9); an anti jumping baffle (3-2) is provided on the upper part of the roller support (3-3) on an outer side of the roller; a groove corresponding to the roller groove (3-1) is provided on an inner side of the anti jumping baffle (3-2).

7. The mooring device capable of providing an omnidirectional restoring force according to claim 3, wherein the rotary damper (7) comprises a sprocket support (7-5) fixed on the longitudinal portion of the support frame (12); the sprocket support (7-5) is provided thereon with a sprocket (7-6); a transmission shaft (7-4) passes through the sprocket support (7-5); the transmission shaft (7-4) on one side of the sprocket support (7-5) is provided thereon with a clutch (7-3), a reduction gear box (7-2) and an electronic inertial sensor (7-7) in sequence from inside to outside; the transmission shaft (7-4) on the other side of the sprocket support (7-5) is provided thereon with a clutch (7-3), a reduction gear box (7-2) and a drive motor (7-1) in sequence from inside to outside.

8. The mooring device capable of providing an omnidirectional restoring force according to claim 3, wherein the two cables (9) located on upper and lower sides of the platform arm (11) are connected to the platform arm (11) through a connection joint (10); the connection joint (10) is provided with a U-shaped groove; connecting holes (10-1) are provided on both sides of the U-shaped groove, and holes corresponding to the connecting holes (10-1) are provided on the platform arm (11); the connection joint (10) is fixedly provided by penetrating a connecting rod through the platform arm holes and the connecting holes (10-1).

9. The mooring device capable of providing an omnidirectional restoring force according to claim 3, wherein a side of the dock (13) is provided with fenders (2) between the platform (1) and the dock (13).

10. The mooring device capable of providing an omnidirectional restoring force according to claim 2, wherein the rotary damper (7) comprises a sprocket support (7-5) fixed on the longitudinal portion of the support frame (12); the sprocket support (7-5) is provided thereon with a sprocket (7-6); a transmission shaft (7-4) passes through the sprocket support (7-5); the transmission shaft (7-4) on one side of the sprocket support (7-5) is provided thereon with a clutch (7-3), a reduction gear box (7-2) and an electronic inertial sensor (7-7) in sequence from inside to outside; the transmission shaft (7-4) on the other side of the sprocket support (7-5) is provided thereon with a clutch (7-3), a reduction gear box (7-2) and a drive motor (7-1) in sequence from inside to outside.

11. The mooring device capable of providing an omnidirectional restoring force according to claim 2, wherein two anti-collision fairlead bases (4) are provided in correspondence in a vertical direction of the cables (9) below the cross arm of the support arm (12) and above the dock (13); the anti-collision fairlead bases (4) are respectively composed of legs (4-3) and a base surface (4-2); lower ends of the legs (4-3) are fixed on a lower side of the cross arm of the support frame (12) or on the dock (13); the base surface (4-2) is provided on the top of the legs (4-3); a center of the base surface (4-2) is provided with a limiting hole (4-1) for the cable (9) to penetrate through; an upper surface of the base surface (4-2) is made of an elastic material.

12. The mooring device capable of providing an omnidirectional restoring force according to claim 2, wherein roller supports (3-3) of the free guide rollers (3) are respectively provided on the lower side of the cross arm of the support frame (12) and on the dock (13); a roller is provided on an upper part of the roller support (3-3); the roller is provided with a roller groove (3-1) for winding the cable (9); an anti jumping baffle (3-2) is provided on the upper part of the roller support (3-3) on an outer side of the roller; a groove corresponding to the roller groove (3-1) is provided on an inner side of the anti jumping baffle (3-2).

13. The mooring device capable of providing an omnidirectional restoring force according to claim 2, wherein the two cables (9) located on upper and lower sides of the platform arm (11) are connected to the platform arm (11) through a connection joint (10); the connection joint (10) is provided with a U-shaped groove; connecting holes (10-1) are provided on both sides of the U-shaped groove, and holes corresponding to the connecting holes (10-1) are provided on the platform arm (11); the connection joint (10) is fixedly provided by penetrating a connecting rod through the platform arm holes and the connecting holes (10-1).

14. The mooring device capable of providing an omnidirectional restoring force according to claim 2, wherein a side of the dock (13) is provided with fenders (2) between the platform (1) and the dock (13).

15. The mooring device capable of providing an omnidirectional restoring force according to claim 1, wherein the two springs (14) are respectively provided in a spring sleeve (5), and the chain (8) is provided thereon with a chain stopper (6) at an end of the two spring sleeves (5), respectively.

16. The mooring device capable of providing an omnidirectional restoring force according to claim 1, wherein two anti-collision fairlead bases (4) are provided in correspondence in a vertical direction of the cables (9) below the cross arm of the support arm (12) and above the dock (13); the anti-collision fairlead bases (4) are respectively composed of legs (4-3) and a base surface (4-2); lower ends of the legs (4-3) are fixed on a lower side of the cross arm of the support frame (12) or on the dock (13); the base surface (4-2) is provided on the top of the legs (4-3); a center of the base surface (4-2) is provided with a limiting hole (4-1) for the cable (9) to penetrate through; an upper surface of the base surface (4-2) is made of an elastic material.

17. The mooring device capable of providing an omnidirectional restoring force according to claim 1, wherein roller supports (3-3) of the free guide rollers (3) are respectively provided on the lower side of the cross arm of the support frame (12) and on the dock (13); a roller is provided on an upper part of the roller support (3-3); the roller is provided with a roller groove (3-1) for winding the cable (9); an anti jumping baffle (3-2) is provided on the upper part of the roller support (3-3) on an outer side of the roller; a groove corresponding to the roller groove (3-1) is provided on an inner side of the anti jumping baffle (3-2).

18. The mooring device capable of providing an omnidirectional restoring force according to claim 1, wherein the two cables (9) located on upper and lower sides of the platform arm (11) are connected to the platform arm (11) through a connection joint (10); the connection joint (10) is provided with a U-shaped groove; connecting holes (10-1) are provided on both sides of the U-shaped groove, and holes corresponding to the connecting holes (10-1) are provided on the platform arm (11); the connection joint (10) is fixedly provided by penetrating a connecting rod through the platform arm holes and the connecting holes (10-1).

19. The mooring device capable of providing an omnidirectional restoring force according to claim 1, wherein a side of the dock (13) is provided with fenders (2) between the platform (1) and the dock (13).

* * * * *